US007004407B2

(12) United States Patent
Cooper

(10) Patent No.: US 7,004,407 B2
(45) Date of Patent: Feb. 28, 2006

(54) UNIFORM METERING SYSTEM FOR SPRAY APPLICATIONS

(75) Inventor: Steven C. Cooper, Athens, GA (US)

(73) Assignee: Mystic Tan, Inc., Farmers Branch, TX (US)

( * ) Notice: Subject to any disclaimer, the term of this patent is extended or adjusted under 35 U.S.C. 154(b) by 230 days.

(21) Appl. No.: 10/310,743

(22) Filed: Dec. 4, 2002

(65) Prior Publication Data

US 2003/0127542 A1 Jul. 10, 2003

Related U.S. Application Data

(60) Provisional application No. 60/337,264, filed on Dec. 4, 2001.

(51) Int. Cl.
*B05B 1/14* (2006.01)

(52) U.S. Cl. ..... 239/550; 239/305; 239/333; 239/549; 132/333; 222/135; 222/330

(58) Field of Classification Search ..... 239/305, 239/332, 333, 548, 549, 550; 4/525, 596, 4/597, 601, 603, 903; 132/333; 119/604, 119/671; 601/154, 155, 159, 160; 222/135, 222/136, 255, 330, 565
See application file for complete search history.

(56) References Cited

U.S. PATENT DOCUMENTS

| | | | | |
|---|---|---|---|---|
| 4,289,276 | A * | 9/1981 | Bollina et al. | 239/305 |
| 4,731,058 | A | 3/1988 | Doan | 604/155 |
| 4,846,525 | A * | 7/1989 | Manning | 297/180.15 |
| 4,941,808 | A | 7/1990 | Qureshi et al. | 417/415 |
| 5,101,679 | A | 4/1992 | Smith et al. | 74/424.8 A |
| 5,460,192 | A * | 10/1995 | McClain | 132/333 |
| 5,545,140 | A | 8/1996 | Conero et al. | 604/154 |
| 5,664,593 | A | 9/1997 | McClain | 132/333 |
| 5,738,728 | A | 4/1998 | Tisone | 118/638 |
| 5,922,333 | A | 7/1999 | Laughlin | 424/401 |
| 6,199,557 | B1 | 3/2001 | Laughlin | 132/200 |
| 6,302,122 | B1 * | 10/2001 | Parker et al. | 132/333 |
| 6,302,662 | B1 | 10/2001 | Bensley et al. | 417/519 |
| 6,802,830 | B1 * | 10/2004 | Waters et al. | 604/289 |

* cited by examiner

*Primary Examiner*—Dinh Q. Nguyen
(74) *Attorney, Agent, or Firm*—Jenkens & Gilchrist, P.C.

(57) ABSTRACT

A metering system includes a pumping device having one or more cylinders, each cylinder having a piston therein that is moved by an automated drive system to produce uniform or proportional flow to a single spray nozzle or a plurality of nozzles. The cylinders are mounted between a common base and a common metering plate. Movement of the metering plate relative to the base causes the pistons to slide within the cylinders to provide pulse-free fluid pumping. A rinsing cylinder or dual-action cylinder can also be included to provide delivery of a rinsing agent or multiple liquids to one or more of the spray nozzles simultaneously or in sequence.

82 Claims, 7 Drawing Sheets

UNIFORM METERING SYSTEM FOR SPRAY APPLICATIONS

CROSS-REFERENCE TO RELATED APPLICATIONS

This U.S. Nonprovisional Application for Patent hereby claims the benefit of the filing date of U.S. Provisional Application for Patent Ser. No. 60/337,264, filed on Dec. 4, 2001, the disclosure of which is hereby incorporated by reference in its entirety.

FIELD OF THE INVENTION

The present invention relates in general to fluid/liquid metering pumps capable of delivering fluid/liquid to spray nozzles, and in particular but not by way of limitation, to a metering system for pulse-free, uniform delivery of fluid/liquid to spray nozzles.

DESCRIPTION OF RELATED ART

Automated sunless tanning spray systems have been recently made commercially available to tanning salons. These systems have the benefit of producing a quality tan on human subjects without exposure to potentially harmful ultraviolet light sources. The primary component of the sprayed tanning solution applied to the skin is usually dihydroxyacetone (DHA), which is mixed with, or used in conjunction with, various lotions and accelerators to produce optimum tanning qualities.

Such commercially available spray tanning systems for dispensing sunless tanning and other lotions typically use either hydraulic or air-atomizing nozzles in various array configurations. Although air-atomizing nozzles are preferred due to their low atomization pressure requirements (e.g., 15 to 30 psi as compared to over 500 psi for hydraulic nozzles), various types of specialty hydraulic nozzles have been used. In addition, electrostatic nozzles have recently been introduced to enhance the efficiency and uniformity of the spray deposition process.

The nozzles are typically placed around the side walls of an enclosure or are located on a moving gantry or several moving gantries placed inside of an enclosure (such as a booth) to attempt uniform spray coverage of the human subject. Between 100 and 400 ml of tanning solution is usually dispensed through this multiple nozzle system in one spray tanning session, which typically takes less than 45 seconds.

The nozzles are plumbed in parallel with several nozzles attached to a common conduit line from a single pumping system. A timer turns on and off the pump and associated solenoid valves to control the amount of liquid dispensed during a tanning session. The pumping system is usually either a reciprocating-piston, peristaltic, diaphragm or gas-pressurized canister system. An additional pump and nozzle set is often used to provide an automatic wash down of the booth once the tanning session is contemplated.

It has been found that significant variations in the tan quality result when spray liquids are dosed improperly during a tanning session. For example, non-uniform, poorly metered or pulsating spray can result in over application, under application, stripes, streaking, or dripping, all of which can produce a less than optimum tan. Due to various inherent characteristics of the liquid dispensing systems used in commercially available spray tanning systems, these systems have produced noticeable variations in dosage from one spray application to the next and between nozzles operating in the same unit.

One such inherent characteristic is the reciprocating nature of many conventional pump designs, which produces undesirable pressure and flow rate pulses at the pump outlet. These pulsations are transferred through hoses to the spray nozzle output. Pulsation is especially evident with slowly reciprocating pumps of low flow rates, typically less than 1 liter per minute. When connected to air-atomizing or hydraulic conventional spray nozzles, this regular pulsing produces droplet size variations and non-uniform spray coating. In addition, time varying dosage changes occur as flow increases and decreases in response to the varying pressure of the pulses. In the case of electrostatic nozzles, the time-varying flow can also cause irregularities in spray charging, which reduces deposition efficiency and uniformity.

One known solution to achieving pulse-free flow is to use a gas-pressurized canister, where a liquid partially fills a vessel and a compressed gas, often air, is introduced into the canister to provide the desired pumping pressure. However, the pressure of the gas must be carefully maintained during the evacuation of the liquid to avoid flow changes over time. Furthermore, pressurized canister methods are not practical in situations where it is undesirable to have contact between the liquid and the pressurizing gas (e.g., several types of tanning solutions are known to degrade over time due to mixture with air).

Pulse-free flow can also be achieved by using various commercially available syringe pumps. Syringe pumps have not been implemented in spray systems for human skin treatments. However they are used primarily in the medical industry and provide precise flow of blood, drugs, or testing reagents in the microliter to milliliter per minute range. In general, syringe pump devices utilize disposable syringes for sterility. However, a single-nozzle airbrush sprayer configuration utilizing a syringe pump for microliter flows is described in U.S. Pat. No. 5,738,728 (hereinafter referred to as the Tisone device), which is hereby incorporated by reference.

The Tisone device achieves flow to a single nozzle by contracting a syringe coupled to a precision lead screw with a computer controlled stepper motor driver. In this configuration, a needle valve within the atomizer and the displacement rate of liquid in the syringe controls the atomization characteristics of a sprayed chemical reagent.

To apply the Tisone device to multi-nozzle spray devices for human skin treatment would require one Tisone device for each nozzle in order to eliminate flow variations between nozzles. Utilizing multiple pumping devices is not practical in certain industrial, agricultural and human skin applications because of increased cost and complexity of the spray system.

Another inherent characteristic in conventional spray tanning systems is the fluid flow variation due to the connection of multiple spray nozzles to a common liquid pressure conduit. For optimal results and reduced waste, it is critical to provide uniform liquid flow from the pumping system to each spray nozzle in spray tanning systems and other systems utilizing nozzle arrays. In systems with several nozzles feeding from one common line, precise calibration of individual nozzles is difficult to achieve without careful attention to nozzle type, length of hoses, and frequent maintenance. Nozzle dimensional variations due to manufacturing, partial clogs or uneven wear can also cause variations in flow between similar nozzles mounted in the spray unit.

Partial clogs often occur in spray systems for batch processes when nozzles are idle for periods of time, such as overnight. Even after rinsing thoroughly, residues of spray compounds may solidify in nozzle orifices, hoses, check valves and flow control valves during idle periods. The clogging problems are especially evident in low flow rate nozzles, such as those used in spray tanning applications, since the orifices are very small, e.g., less than 0.6 mm in diameter. Filters before each nozzle are typically required for such small orifice nozzles. However, the filters themselves can become clogged, which can create uneven pressure in the flow system if the filters are not meticulously maintained.

To adjust uneven flow to multiple nozzles, needle valves are often installed in lines to individual nozzles. However, needle valves require frequent adjustment to ensure proper flow, and each time flow is adjusted, calibration measurements are necessary. Such calibration is time consuming and messy since spray must be collected from each nozzle for a timed period.

A further inherent characteristic of conventional spray systems with multiple nozzles is the uneven flow to spray nozzles caused by check valves that are used to control flow direction. Check valves are often connected to each nozzle to prevent dripping from nozzles after pump systems or solenoids stop the liquid flow. However, the wide manufacturing tolerances in check valves can cause variations in check valve opening pressures, which can result in uneven flow to nozzles plumbed to a common inlet. In addition, spray residue can build up inside check valves, causing the check valves to stick closed or partially closed, which can contribute to pressure variations at nozzle inlets while the spray system is operating.

Another inherent characteristic of conventional spray tanning systems is the formation of air pockets in the hoses from the liquid reservoir to the pump and in the hoses from the pump to the nozzles. When the tanning systems are not utilized for a period of time, a portion of the solution primed in the hoses to the nozzles drains by gravity back through the pump and into the solution tank. When the spray unit is energized again after this period of non-use, the air pockets in hoses, fittings and nozzles can cause spitting and uneven flow at the nozzles, resulting in poor spray coverage and less than desired dosage during the session. Often several cycles of operation are required to prime the system full again.

Another problem with conventional spray tanning systems is the complexity of the pumping system utilized to provide delivery of several different liquids to the nozzles. Multiple-liquid systems are necessary when spraying combinations of liquids that are best mixed in precise ratios at or near the point of atomization or when different fluids are dispensed in sequence. In the sunless tanning industry, an example of this is the mixture of accelerants with the DHA compound to enhance color, reduce color development time and increase the duration of the tan. In some situations, it may be desirable mix these components at or within the nozzle. Such multiple-liquid systems are usually designed with an individual pump for each of the dispensed liquids and control systems to direct the flow to the nozzles. Requiring a separate pump for each liquid increases the complexity and cost of the pumping system.

An alternative pumping system is shown in U.S. Pat. No. 6,302,662 (hereinafter referred to as the Bensley device), which is hereby incorporated by reference, in which a multiple cylinder pump system includes a valve arrangement to allow selection of various fluids. However, the Bensley device requires multiple drives for each pump. In addition, there is a possibility of premature combination of pumped liquids in the valve chambers or outlet hoses in the Bensley device.

Therefore, what is needed is a metering system for providing pulse-free metered liquid delivery to a wide variety of spray nozzle types. In addition, what is needed is a metering system for providing uniform distribution of liquid to multiple nozzles independent of the individual flow characteristics of the nozzles, conduits, filters, check valves or other flow impediments in the system. Furthermore, what is needed is a metering system for delivering multiple liquids to nozzles with reduced pumping system complexity.

SUMMARY OF THE INVENTION

Embodiments of the present invention provide a metering system for uniformly delivering fluid/liquid to one or more spray nozzles. The preferred embodiment of the metering system utilizes a pumping device including one or more cylinders, each cylinder having a piston therein that is moved by an automated drive system to produce uniform or proportional flow to a single spray nozzle or a plurality of nozzles. Each cylinder is connected to provide fluid/liquid to a set of nozzles with each set including one or more individual nozzles.

In one embodiment, all of the cylinders are mounted between a common base and a common metering plate. Movement of the metering plate relative to the base causes the pistons to slide within the cylinders to provide pulse-free fluid pumping. Movement in a first direction results in the drawing of liquid into the cylinder from a reservoir, and movement in a second direction causes the liquid to be metered out to the spray nozzle(s). Check valves are connected to the inlet and outlet conduits of each cylinder to control the direction of flow. The volumetric flow rate of the liquid from the output of each cylinder is a function of the speed at which the piston Is moved and the diameter of the cylinder.

In further embodiments, a rinsing cylinder can be included to provide delivery of a rinsing agent (for example, a cleaning fluid) to all of the spray nozzles during the drawing of liquid into the other cylinders. In still further embodiments, a dual action cylinder can be included to dispense two solutions in sequence.

The preferred embodiment of the metering system of the present invention is capable of delivering fluid/liquid to any nozzle type, including pressure-feed, siphon-feed or electrostatic types. In addition, multiple fluids/liquids are capable of being dispensed to individual or separate spray nozzles in precise mixture ratios.

Advantageously, embodiments of the present invention enable pulse-free flow during the spray period. In addition, time-varying flow can also be achieved during the spray period, if desired. Furthermore, embodiments of the present invention enable uniform flow to multiple nozzles with a less than one-percent variation between batches and between nozzles.

Although a preferred embodiment of the present invention utilizes a piston-type pump, the spray system of the present invention could alternatively use a multi-line peristaltic pumps, solenoid pumps, or diaphragm pumps alone or in combination with each other and/or the piston-type pump disclosed herein.

BRIEF DESCRIPTION OF THE DRAWINGS

A more complete understanding of the method and apparatus of the present invention may be had by reference to the following detailed description with like reference numerals denoting like elements when taken in conjunction with the accompanying drawings wherein.

DETAILED DESCRIPTION OF THE INVENTION

Figure 1:
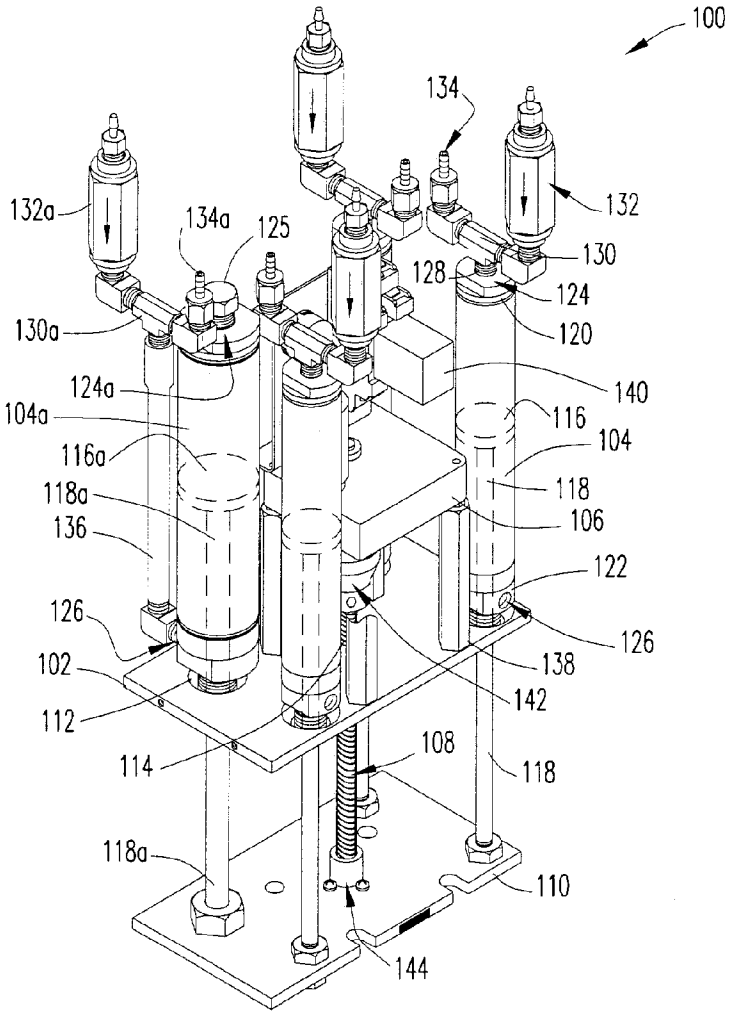
FIG. 1 is an isometric view of a pumping device according to the principles of the present invention.

Referring now to FIG. 1, an isometric view of a pumping device 100 according to the principles of the present invention is shown. The pumping device 100 includes a base 102 and a plurality of cylinders 104 connected to the base 102. A motor 106 is provided connected to the base 102 and having a lead screw 108 extending therefrom. A metering plate 110 is connected to the other end of the lead screw 108 and is substantially parallel to the base 102.

The base 102 is substantially rectangular, but may be of any appropriate geometric orientation. The base 102 includes a plurality of openings 112 adapted to receive and connect thereto the plurality of cylinders 104. Disposed in the center of the base 102 is a lead orifice 114. The lead orifice 114 is adapted to receive the lead screw 108 therethrough and to allow rotation of the lead screw 108 relative to the base 102.

The cylinders 104 include a respective piston 116 slidably received therein. A piston rod 118 is coupled to the respective piston 116 and adapted to move the piston 116 within the cylinder 104. A top end cap 120 and a bottom end cap 122 enclose the cylinder 104. The bottom end cap 122 is adapted to allow the piston rod 118 to freely move therethrough.

On some cylinders 104, a vent hole 126 may be provided adjacent the bottom end cap 122 to vent air from within the cylinder 104. In other configurations, the vent hole 126 may be used as a port opening to allow liquid to flow into and out of the cylinder 104 (see, for example, cylinder 104*a*). Similarly, such a port opening 124 is formed within a top end cap opening 128 to the cylinder 104 to allow liquid to flow into and out of the cylinder 104.

A T-driver 130 extends from the top end cap opening 128 and communicates with a check valve 132 and an exit fitting 134. Both the check valve 132 and exit fitting 134 may be adapted to allow unidirectional flow of gas (such as air) or liquid therethrough. Similarly, the port opening 124 communicates with the cylinder 104 and connects to the T-divider 130, which in turn communicates with the check valve 132 and exit fitting 134.

The cylinders 104 may be of differing volumes, such as that denoted by reference 104*a*. Because of the larger cylindrical volume of the cylinder 104*a*, the piston 116*a* will likewise correspondingly increase in diameter to maximize pumping efficiency. In addition, the piston rod 118*a* may also increase in diameter. The larger cylinder 104*a* may be used to provide a different liquid, such as a rinsing or cleaning solution/product.

The check valves 132 can be connected via the T-dividers 130 to either the top or bottom chambers of the cylinders 104 depending on the cylinder 104 pumping cycle. For example, the check valve 132*a* for rinsing cylinder 104*a* is connected via piping 136 and T-divider 130*a* to the bottom chamber of the rinsing cylinder 104*a* to operate in a reverse suction and pumping cycle, as compared to the other cylinders 104. For example, a rinsing solution may be received into rinsing cylinder 104*a* via check valve 132*a*, T-divider 130*a*, piping 136 and vent hole 126*a* and delivered via vent hole 126*a*, piping 136, T-divider 130*a* and exit fitting 134*a*.

The motor 106 is coupled to the base 102 by a plurality of motor mounts 138. The motor mounts 138 maintain the motor 106 a predetermined fixed distance from the base 102. Motor control electronics 140 may be coupled directly to the motor 106 to power the motor 106 and control rotation of the lead screw 108 connected to the motor 106. A lead screw coupler 142 connects to the base-facing side of the motor 102 at one end and to the lead screw 108 at the other. Accordingly, when the motor 106 is actuated, the lead screw 108 may rotate in a predetermined clockwise or counterclockwise direction. In addition, the motor 106 may be operated at varying speeds to change flow between cycles or within a given cycle.

The metering plate 110 is connected to the other end of the lead screw 108 via a nut 144 or other fastener, such that actuation of the motor 106 with the corresponding rotation of the lead screw 108 results in the metering plate 110 moving either closer to or farther from the base 102. Respective piston rods 118, 118*a* are coupled to the metering plate 110, such that when the metering plate 110 is moved closer to the base 102, the piston rods 118, 118*a* move in the same axial direction. When the lead screw 108 separates the metering plate 110 from the base 102, the pistons 116, 116*a* axially descend within the respective cylinders 104, 104*a*.

Although a lead screw is illustrated for effectuating the movement of the base and metering plate relative to one another, it will be recognized that other options exist such as, for example, hydraulic drive, pneumatic actuator, and mechanical drives (like a lever).

With respect to cylinders 104, when the metering plate 110 is moved closer to the base 102, liquid or gas is compressed in the area between the respective piston 116 and the top end caps 120. When the metering plate 110 is separated from the base 102, liquid or gas is drawn into the area between the pistons 116 and respective top end caps 120.

With respect to rinsing cylinder 104*a*, when the metering plate 110 is separated from the base 102, liquid within the rinsing cylinder 104*a* between the piston 116*a* and the bottom end cap 122*a* is forced through the vent hole 126 and into the exit fitting 134*a* via hose 136. Likewise, when the metering plate 110 is moved closer to the base 102, liquid or gas is suctioned into the rinsing cylinder 104*a* between the piston 116*a* and the bottom end cap 122*a* via check valve 132*a*.

Although the rinsing cylinder is disclosed as pumping a subsequent rinsing solution, it will be understood that this cylinder could be used to dispense any solution, liquid, fluid and/or gas, as is required by the particular application. For example, the cylinders 104 could be used to dispense an application solution (such as, for example, a sunless tanning solution) and the cylinder 104*a* could be used to apply a secondary solution (such as, for example, an accelerant or lotion that supplements or enhances the previously dispensed tanning solution).

Figure 2:
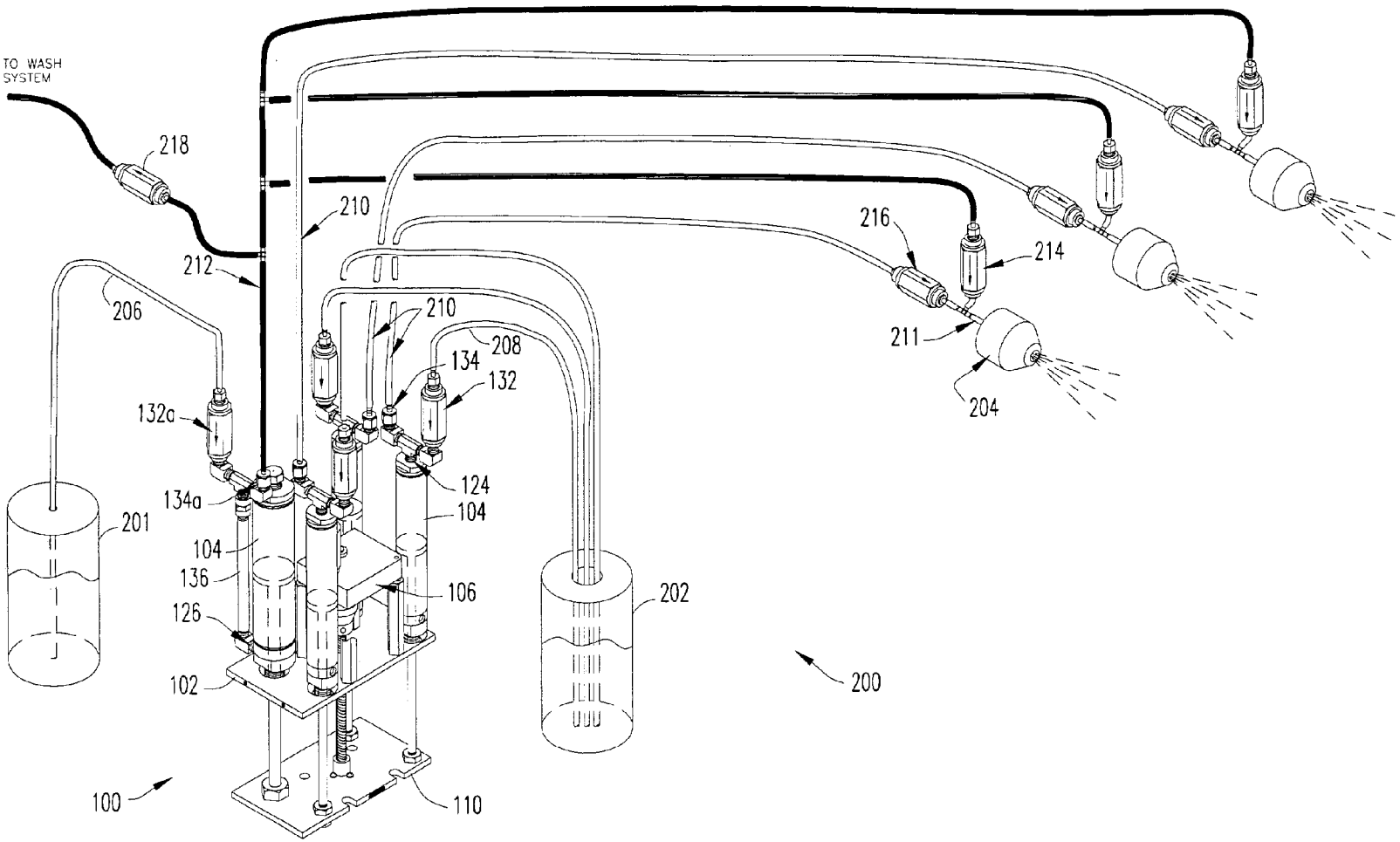
FIG. 2 is an isometric view of the operation of the pumping device of FIG. 1 within a metering system.

Referring now to FIG. 2, an isometric view of the pumping device 100 of FIG. 1 is shown within a metering system 200. The pumping device 100 is connected to a first reservoir 201, a second reservoir 202, and to spray nozzles 204. The nozzles 204 can be any nozzle type, including those having pressure or venturi feed. By way of example, but not limitation, the nozzle types can include hydraulic, air-assisted, air-atomizing or electrostatic types The first reservoir 201 is connected via a rinse line 206 to the check valve 132*a*, which in turn is connected to the rinsing cylinder 104*a*. A rinse solution concentrate or diluted rinse solution is provided within the first reservoir 201. The second reservoir 202 is connected via fluid lines 208 to respective cylinders 104. A desired fluid, such as tanning solution, is provided within the second reservoir 202. However, it should be understood that the present invention is not limited to tanning solutions, but rather can extend to any spray application, such as post harvest spraying of bananas and other agricultural products, dispensing of veterinary pharmaceuticals and spray coating of various work pieces in manufacturing.

The port openings 124 of each cylinder 104 communicate with connections to hoses 210 to provide fluid to respective nozzles 204 via exit fittings 134 and check valves 216. The vent hole 126*a* of rinsing cylinder 104*a* communicates with a connection to an outlet hose 212 to provide fluid (e.g., rinsing solution) to all of the nozzles 204 via exit fitting 134*a* and check valves 214. Check valves 214 further communicate with respective hoses 211 to connect the hoses 210 with the hoses 211 in order to provide liquid to the nozzles 204.

The diameter of the hoses 210, 211 and 212 may be small in order to minimize the amount of fluid contained therein. In addition, the hoses 211 near the nozzles 204 may have a short length, as compared to hoses 210 and 214, to minimize the mixing space for the two liquids. Furthermore, providing two fluid entryways into the nozzles 204 (e.g., via check valve 214 and check valve 216) can further minimize mixing of the two fluids. In other embodiments, two or more inlets could be fashioned into the nozzle 204 to minimize mixing of separate spray components. In one embodiment, the nozzles 204 are air-atomizing nozzles, which allow the nozzle venturi to purge the nozzle conduits and any small lengths of the hoses 211 if air is operated with the pumping system off.

In operation, there are two half cycles, one for metering liquid (e.g., tanning solution) to the nozzles 204 and another for metering rinsing solution to the nozzles 204. During the first half of the pump cycle, liquid flows from the cylinders 104 to respective nozzles 204. During the second half of the pump cycle, rinsing solution flows from the cylinder 104*a* to all of the nozzles 204 through the outlet hose 212.

In the first half of the pump cycle, when the metering plate 110 is drawn towards the base 102, compression occurs in the upper chamber of the cylinders 104 and suction is caused in the lower chamber of the cylinder 104*a*. Check valves 132 and 132*a* control the direction of the liquid flow. The expelled fluid from cylinders 104 is directed toward spray nozzles 204 via exit fittings 134. At the same time, fluid is drawn from the reservoir 201 into the cylinder 104*a* via the check valve 132*a* and the piping 136.

In the second half of the pump cycle, the motor 106 is reversed to draw fluid from the reservoir 202 through check valves 132 into the upper chamber of the cylinders 104. At the same time, fluid is expelled through the outlet hose 212 from the cylinder 104*a* to the nozzles 204 via the exit fitting 134*a*. A portion of the flow through the outlet hose 212 can be directed towards a wash down nozzle system (not shown) through check valve 218. Rinsing the nozzles 204 after each spray session reduces the maintenance requirements of the nozzles 204, check valves 132 and 214 and other system components by preventing clogging in the system.

Figure 3:
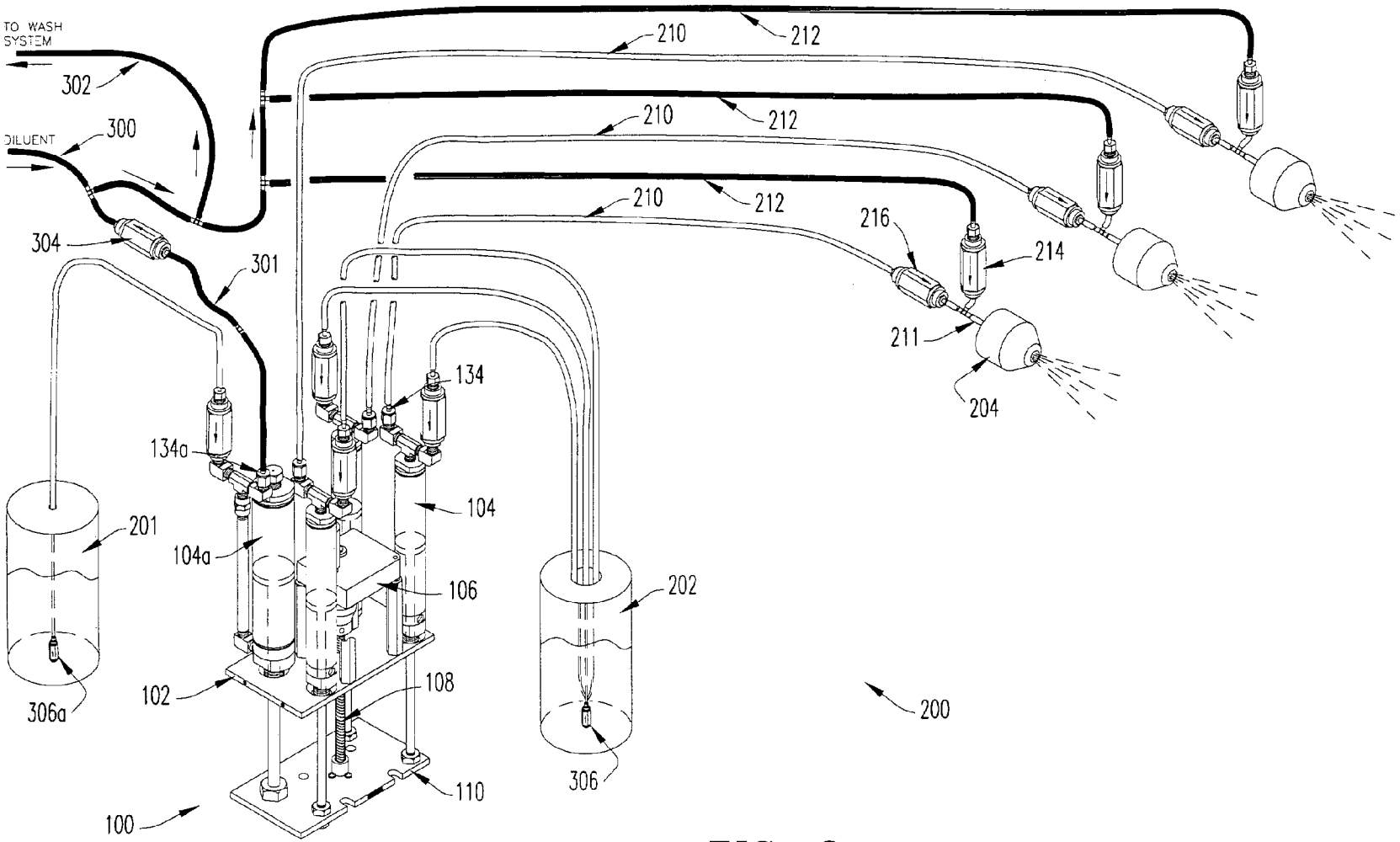
FIG. 3 is an isometric view of the metering system of FIG. 2 with the introduction of a diluent to the system.

Referring now to FIG. 3, an isometric view of the metering system 200 is shown having a diluent added to the output of the cylinder 104*a*. A diluent may be necessary when a concentrated solution is dispensed from reservoir 201 through the cylinder 104*a*. The diluent may be water or other diluent. The diluent enters through a hose 300 and combines with the concentrated rinsing solution delivered via hose 301 and check valve 304. The diluted rinsing solution is carried over hose 212 towards the nozzles 204. The diluted rinsing solution may also flow through hose 302 for rinsing the interior of a spray booth.

Foot valves 306*a* and 306 at the bottom of the reservoirs 201 and 202, respectively, prevent fluid from returning to the reservoirs 201 and 202 and air pockets from forming in the system conduits. It should be understood that although the foot valves 306 and 306*a* are not shown on other Figures, they may be used in all metering system configurations to prevent air pockets from forming in the system's conduits (e.g., hoses, cylinders, check valves and nozzles).

In operation, in FIG. 3, the first half of the pump cycle occurs when the lead screw 108 rotates to move the metering plate 110 towards the base 102 and the pumping device 100 provides liquid from the reservoir 202 metered independently from three cylinders 104 to three nozzles 204. Reversing the lead screw drive motor 106 in the second half of the pump cycle causes a condensed fluid (for example, a rinsing solution) from the reservoir 201 metered from cylinder 104*a* to be mixed with a diluent via hoses 300 and 301 and check valve 304. The diluted fluid is delivered to all nozzles 204 through hoses 212 and check valves 214.

Figure 4:
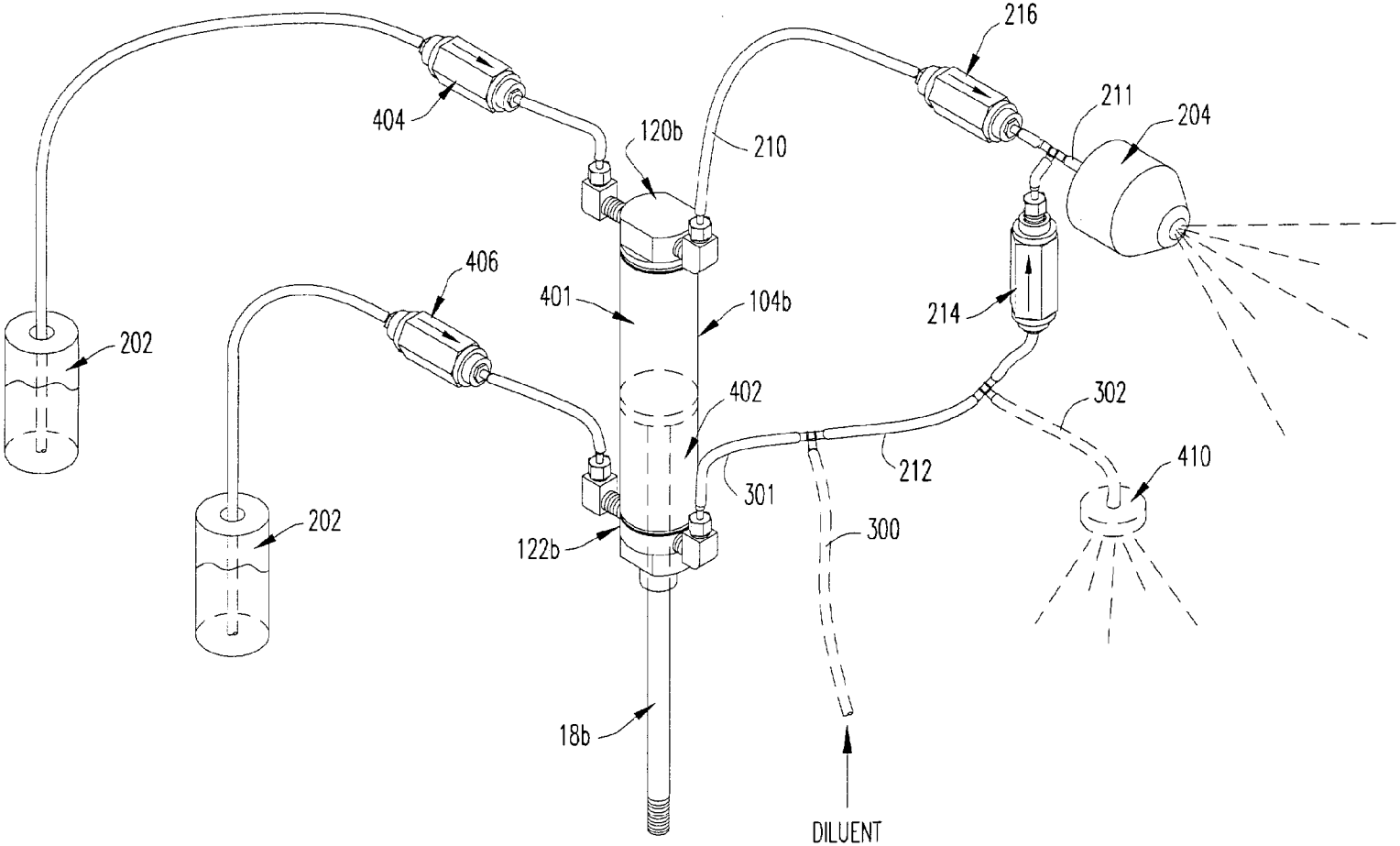
FIG. 4 is an isometric view of another embodiment of a metering system according to the principles of the present invention having a sequential spray configuration.

Referring now to FIG. 4, an isometric view of another embodiment of the metering system 200 according to the principles of the present invention is shown having a sequential spray configuration. A dual-action chamber cylinder 104*b* is shown that is capable of pumping two solutions in sequence. It should be understood that only one dual-action cylinder 104*b* and one nozzle 204 are shown for simplicity. However, additional cylinders (104, 104*a* or 104*b*) and additional nozzles could be used. A dual-action cylinder 104*b* may be used to dispense a spray solution during the first half of the pump cycle and to dispense a rinsing solution during the second half of the pump cycle.

The dual-action cylinder 104*b* includes an upper chamber 401 and a lower chamber 402. A spray solution from the reservoir 202 is drawn into the upper chamber 401 via a check valve 404 connected to the top end cap 120*b* of the cylinder 104*b*. A rinsing solution is drawn from the reservoir 201 into the lower chamber 402 via a check valve 406 connected to the bottom end cap 122*b* of the cylinder 104*b*.

In operation, when the piston rod 118*b* is moved inward, liquid is expelled from the upper chamber 401 of the cylinder 104*b* to the nozzle 204 through the check valve 216 over hoses 210 and 211. During the same cycle, liquid from the reservoir 201 is drawn into the lower chamber 402 of the cylinder 104*b* through the check valve 406. When the piston rod 118*b* is moved outward, liquid from the lower chamber 402 of cylinder 104*b* is expelled to the nozzle 204 through check valve 214 over hoses 301, 212 and 211. During the same cycle, liquid from the reservoir 202 is drawn into the upper chamber 401 of the cylinder 104*b* through the check valve 404.

As in FIG. 3, the liquid expelled from the lower chamber 402 of the cylinder 104*b* may be diluted by introducing a pressurized diluent through hose 300. The diluted rinsing solution may also be provided to a wash nozzle 410 over hose 302 for the purpose of cleaning a spray booth. In a simplified system without a liquid diluent, air may also be used to purge the nozzle and inlet hose 211 during the compression cycle of the lower chamber 402 by opening the upstream side of the check valve 406 to atmosphere.

Figure 5:
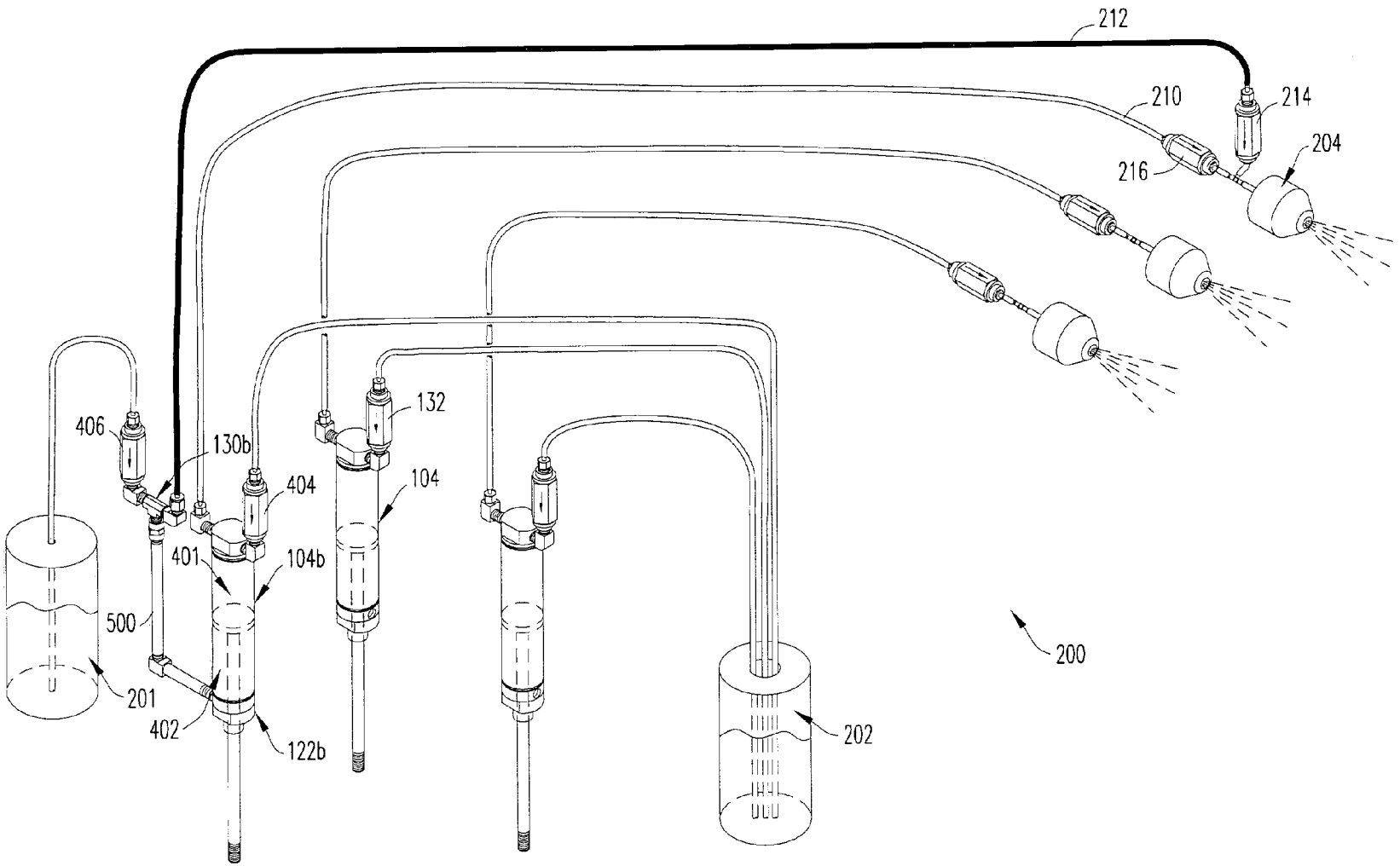
FIG. 5 is an isometric view of the metering system of FIG. 4 having a sequential spray configuration for one of the cylinders.

Referring now to FIG. 5, an isometric view of the metering system of FIG. 4 is shown implementing a dual-action cylinder 104*b* to provide injection of a second liquid during a pump cycle operation. In FIG. 5, the large cylinder 104*a* in FIG. 2 has been eliminated and one of the cylinders 104 has been replaced by a dual-action cylinder 104*b*. FIG. 5 further shows the use of a T-divider 130*b* connected to a single bottom end cap opening in the bottom end cap 122*b* of the dual-action cylinder 104*b* via piping 500. However, it should be understood that separate bottom end cap openings can be used to connect to the bottom end cap 122*b* for suctioning and pumping actions.

For simplicity, FIG. 5 shows connection of the hose 212 and check valve 214 to only one nozzle 204. However, it should be understood that these connections could be made to all nozzles 204 as previously shown in FIG. 2. It should further be understood that the metering system 200 of FIG. 5 may also be used with the option of an added diluent, as shown in FIGS. 3 and 4.

In operation, during the first half of the pump cycle, the metering system in FIG. 5 may dispense of a spray solution from the reservoir 202 to nozzles 204 via cylinders 104 and 104*b*. During the second half of the pump cycle, a second solution may be dispensed from reservoir 201 to nozzles 204 via cylinder 104*b*. It should be understood that one or all cylinders may be dual-action cylinders 104*b* feeding nozzles independently or in parallel.

Figure 6:
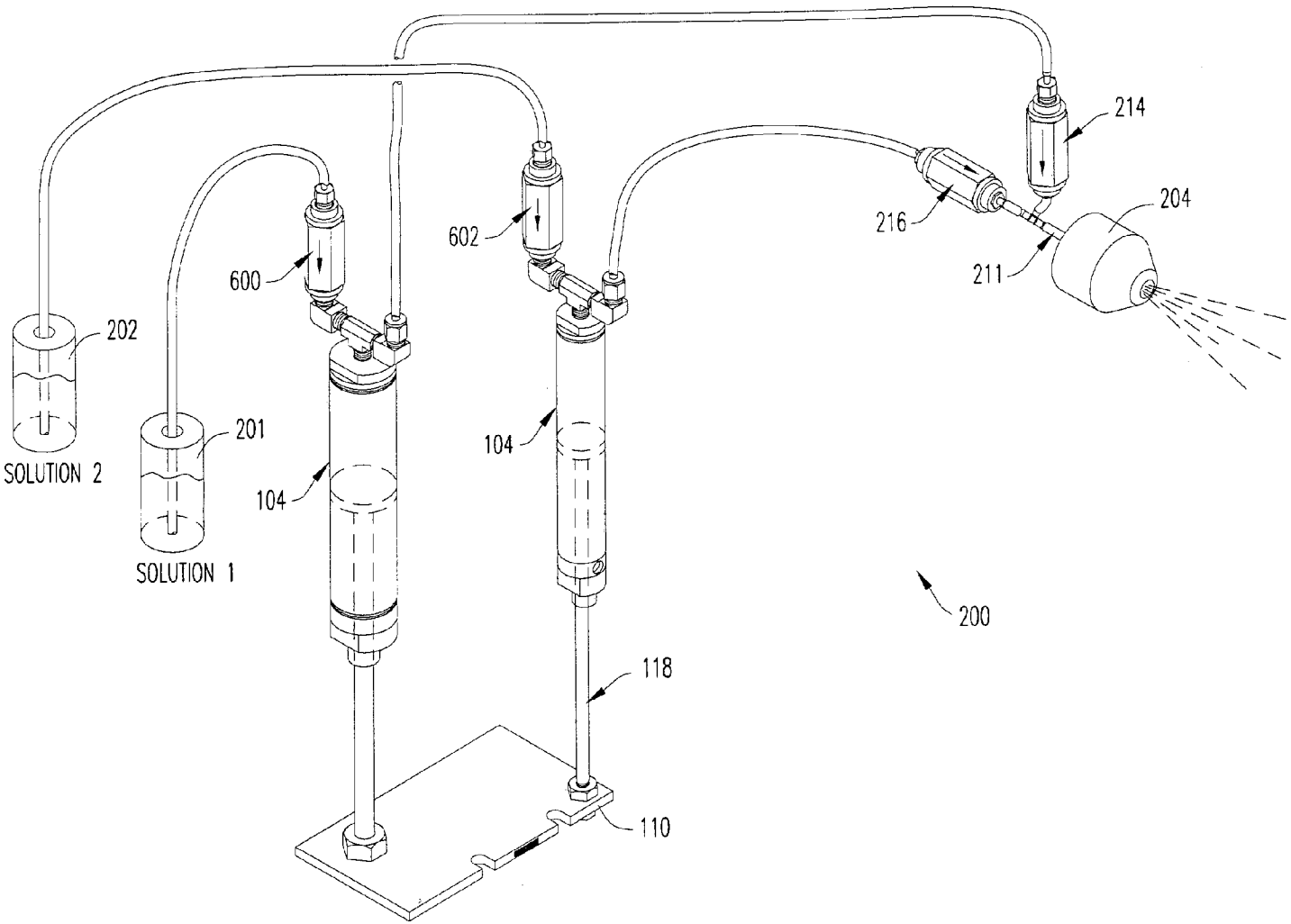
FIG. 6 is an isometric view of another embodiment of a metering system according to the principles of the present invention having multiple liquids spraying from one nozzle.

Referring now to FIG. 6, an isometric view of another embodiment of a metering system 200 according to the principles of the present invention is shown having multiple liquids spraying simultaneously from one nozzle 204. For simplicity purposes, only one nozzle 204 and two single chamber cylinders 104 are shown. However, it should be understood that several cylinders of single or dual chambers and several nozzles may be used without deviation from the present invention. The use multiple cylinders and dual-action cylinders allows metering of additional fluids simultaneously and in sequence.

In the configuration of FIG. 6, two liquids are metered in proportion from reservoirs 201 and 202 to the spray nozzle 204. When the piston rods 118 and common metering plate 110 are moved inward, liquid is expelled from the cylinders 104 to the nozzle 204 through check valves 214 and 216. Reversing the operation of the piston rods 118 causes liquid from reservoirs 201 and 202 to fill the cylinders 104 through check valves 601 and 602, respectively. The use of cylinders 104 of different diameter allows fluid to be metered proportionally. The hose 211 between the check valves 214 and 216 and the nozzle 204 may be kept short in length to minimize premature mixing of the liquids. In other embodiments, there may be two inlets fashioned into the nozzle 204 itself.

The pumping of multiple solutions, liquids, fluids or gases has been discussed in connection with the operation of the system as described above and illustrated in the accompanying Figures. The benefits of such an operation may be better understood by reference to some specific examples. First, consider the use of the system in connection with the primary metering and spraying of a certain fluid. The sequential spraying operation discussed above allows for the dispensing of that fluid followed by the dispensing of another fluid (for example, a sunless tanning solution followed by and accelerant, lotion or cleaner; or alternatively, the dispensing or a preparatory solution followed by the tanning solution itself). The simultaneous spraying operation discussed above allows for the dispensing of two fluids in precise metered amounts (for example, a sunless tanning solution plus an accelerant in a precise proportion). The system further allows for a single pumping mechanism to be used for the dispensing of the sequential fluids. The system still further allows for multiple pumping mechanisms to be used to pump the same or different fluids to the same or different sets of nozzles. In this way a more efficient and uniform spraying result is achieved. The system further allows a common drive mechanism to be utilized to operate plural pumps in a coordinated effort. Furthermore, the system supports delivery at different rates and different volumes.

Figure 7:
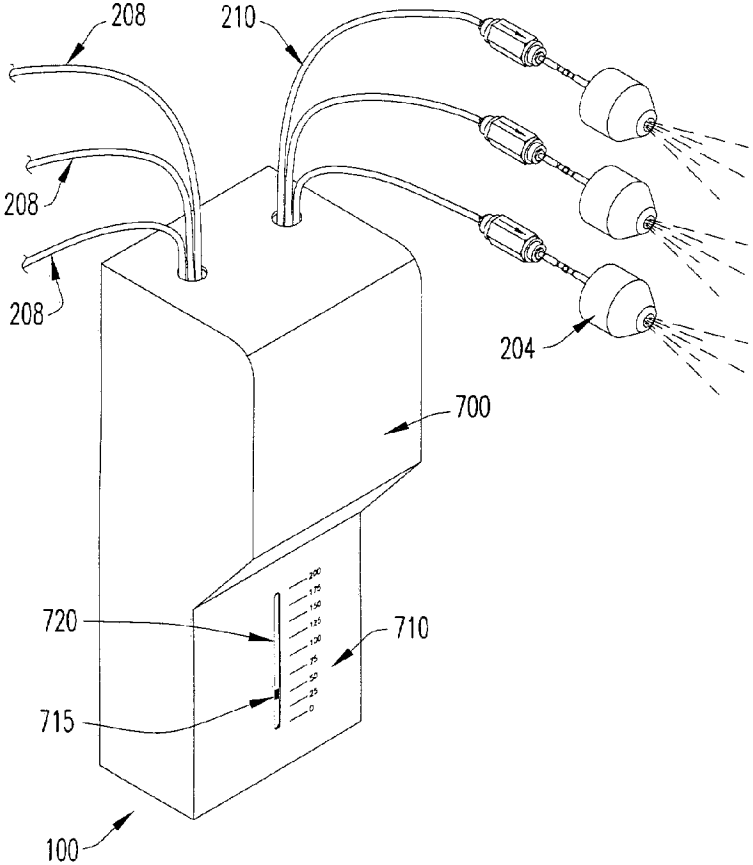
FIG. 7 is an isometric view of a pumping device according to the principles of the present invention having a calibration scale thereon.

FIG. 7 is an isometric view of a pumping device 100 according to the principles of the present invention having a cover 700 thereon. The cover 700 contains the pumping device 100 according to the present invention. A calibration scale 710 is visible on the cover 700 to allow viewing of a portion of the metering plate edge 715 through a slot 720. Hoses 210 leading to spray nozzles 204 are shown coming from the cover 700. Hoses 208 to liquid reservoir(s) (not shown) are shown going into the cover 700.

The calibration scale 710 allows for easy checking of the amount of liquid dispensed during a batch spraying operation. The metering plate edge 715 moves relative to the calibration scale 710 during the spraying process. At the end of the spraying process, the total amount of liquid dispensed can be determined without the need of collecting spray from the nozzles. Multiple slots 720 and scales 710 could be utilized in the event multiple cylinders are employed with differing diameters.

Figure 8:
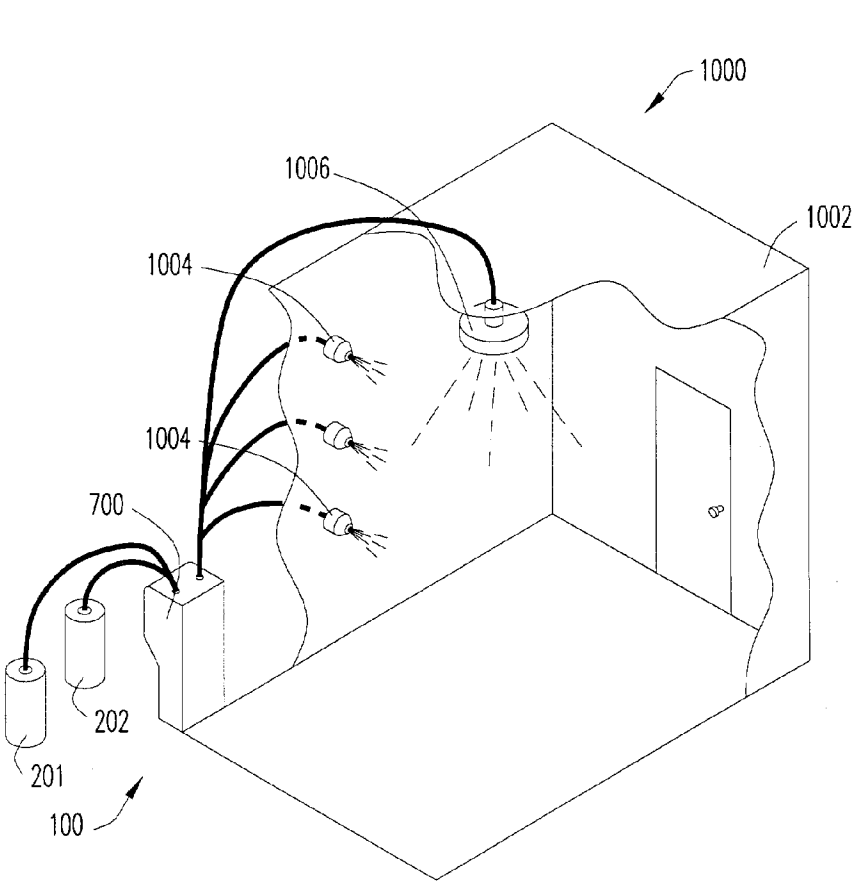
FIG. 8 is a schematic view of a product dispensing booth utilizing the pumping device of the present invention.

Reference is now made to FIG. 8 wherein there is shown a simplified schematic view of a product dispensing booth utilizing the pumping device of the present invention. More specifically, the product dispensing booth comprises a sunless tanning spray booth 1000 connected to the pumping device 100 (illustrated with its cover 700 present). The booth presents an enclosure 1002 which may comprise a containing booth or chamber-like structure that is stand-alone in nature. Alternatively, the enclosure 1002 may comprise a room that is not stand-alone. Mounted to the walls of the enclosure 1002 are a plurality of nozzles 1004 (like the nozzles 204 referenced in the prior FIGURES). It is through these nozzles 1004 that a sunless tanning solution is sprayed. That tanning or other hum skin treatment solution comprises the solution that is stored in the reservoirs/tanks 202 referenced in the prior FIGURES. A second solution is also sprayed through the nozzles 1004, either after or in conjunction with the spraying of the tanning solution. This second solution comprises the solution that is stored in the reservoirs/tanks 201 referenced in the prior FIGURES. In a preferred embodiment, this second solution is a cleaning solution that is sprayed after the tanning solution in order to clean the nozzles. In another embodiment, the second solution may an additional human skin treatment solution that is sprayed either before, after or along with the tanning solution. The enclosure 1002 may further include a wash nozzle (or cleaning system) 1006 (like the nozzle 410 referenced in the prior FIGURES). This wash nozzle 1006 is preferably used to spray a cleaning solution within the enclosure 1002 and thus wash the walls, floor and ceiling of the enclosure. This enclosure cleaning solution may comprise, for example, the same second solution referenced above that is also used to clean the nozzles 1004. Although one wash nozzle is shown, it will be recognized that more than one may be necessary to clean the enclosure.

It is thus believed that the operation and construction of the present invention will be apparent from the foregoing description of the preferred exemplary embodiments. It will be obvious to a person of ordinary skill in the art that various changes and modifications may be made herein without departing from the spirit and the scope of the invention.

What is claimed is:

1. A dispensing device for more uniformly coating human skin with one or more liquid products, comprising:

at least one first spray nozzle;

at least one second spray nozzle;

a first pumping mechanism that pumps liquid product through the at least one first spray nozzle for application to coat human skin; and a second pumping mechanism that pumps liquid product through the at least one second spray nozzle for application to coat human skin; and wherein each of the at least one first spray nozzle and the at least one second spray nozzle each include a plurality of individual spray nozzles.

2. The device of claim 1 wherein the liquid product is a sunless tanning solution.

3. A dispensing device for more uniformly coating human skin with one or more liquid products, comprising:

at least one first spray nozzle;

at least one second spray nozzle;

a first pumping mechanism that pumps liquid product through the at least one first spray nozzle for application to coat human skin; and a second pumping mechanism that pumps liquid product through the at least one second spray nozzle for application to coat human skin; and wherein at least one of the first and second pumping mechanisms further pumps a cleaning liquid through the at least one first spray nozzle and the at least one second spray nozzle following liquid product application to the human skin.

4. A dispensing device for more uniformly coating human skin with one or more liquid products, comprising:

at least one first spray nozzle;

at least one second spray nozzle;

a first pumping mechanism that pumps liquid product through the at least one first spray nozzle for application to coat human skin;

a second pumping mechanism that pumps liquid product through the at least one second spray nozzle for application to coat human skin; and a third pumping mechanism that pumps a supplemental liquid through at least one of the at least one first spray nozzle and the at least one second spray nozzle.

5. The device of claim 4 wherein the supplemental liquid is pumped to at least one of the at least one first spray nozzle and the at least one second spray nozzle simultaneously with the liquid product.

6. The device of claim 4 wherein the supplemental liquid is pumped to at least one of the at least one first spray nozzle and the at least one second spray nozzle subsequent to the liquid product.

7. The device of claim 4 wherein the supplemental liquid is a cleaning solution.

8. The device of claim 4 wherein the liquid product is a sunless tanning solution and the supplemental liquid is an accelerator for the sunless tanning solution.

9. The device of claim 4 wherein the liquid product is a sunless tanning solution and the supplemental liquid is a lotion.

10. The device of claim 4 wherein each of the first, second and third pumping mechanisms comprises a piston pump actuated by a drive mechanism.

11. The device of claim 10 wherein the drive mechanism comprises a screw-type drive.

12. The device of claim 10 wherein the piston pump for the first pumping mechanism and the piston pump for any other included pumping mechanism have different volumes.

13. The device of claim 10 wherein the piston pump for the first pumping mechanism and the piston pump for the second pumping mechanism have different volumes.

14. A dispensing device for more uniformly coating human skin with one or more liquid products, comprising:

at least one first spray nozzle;

at least one second spray nozzle;

a first pumping mechanism that pumps liquid product through the at least one first spray nozzle for application to coat human skin;

a second pumping mechanism that pumps liquid product through the at least one second spray nozzle for application to coat human skin;

a wash nozzle; and a pumping mechanism that pumps a cleaning liquid through the wash nozzle.

15. The device of claim 14 wherein the pumping mechanism for the cleaning liquid comprises at least one of the first and second pumping mechanisms and wherein that at least one of the first and second pumping mechanisms pumps liquid product in a first half-cycle of pumping operation and pumps the cleaning liquid in a second half-cycle of pumping operation.

16. The device of claim 15 wherein the at least one of the first and second pumping mechanisms further pumps the cleaning liquid through a corresponding at least one of the at least one first spray nozzle and the at least one second spray nozzle in the second half-cycle of pumping operation.

17. The device of claim 14 further including a source of diluent, with the sourced diluent added to the pumped cleaning liquid.

18. A dispensing device for more uniformly coating human skin with one or more liquid products, comprising:

at least one first spray nozzle;

at least one second spray nozzle;

a first pumping mechanism that pumps liquid product through the at least one first spray nozzle for application to coat human skin; and a second pumping mechanism that pumps liquid product through the at least one second spray nozzle for application to coat human skin; and wherein each of the first and second pumping mechanisms comprises a piston pump actuated by a drive mechanism.

19. The device of claim 18 wherein the drive mechanism comprises a screw-type drive.

20. The device of claim 18 wherein the piston pump for the first pumping mechanism has a first volume and the piston pump for the second pumping mechanism has a second, different, volume.

21. The device of claim 18 further including an enclosure within which the at least one first spray nozzle and the at least one second spray nozzle are mounted, the enclosure being sized and shaped to receive at least a portion of a human body, the at least one first spray nozzle and the at least one second spray nozzle positioned to coat the skin of the received portion of the human body.

22. The device of claim 21 wherein the enclosure is sized and shaped to receive an entire human body, the at least one first spray nozzle and the at least one second spray nozzle positioned to coat the skin of the entire human body in a substantially uniform manner.

23. The device of claim 22 wherein the enclosure is a sunless tanning booth and at least one of the at least one first spray nozzle and the at least one second spray nozzle applies a sunless tanning solution.

24. The device of claim 18 wherein the first pumping mechanism and second pumping mechanism pump different liquid products.

25. The device of claim 18 wherein the first pumping mechanism and second pumping mechanism are operated simultaneously.

26. A dispensing device for uniformly delivering fluids, comprising:

a first cylinder having a first piston slidably received therein;

a second cylinder having a second piston slidably received therein;

a drive system adapted to cause simultaneous axial movement of said first and second pistons within said first and second cylinders, respectively, such axial movement during a first half-cycle of piston operation causing a first fluid to be drawn into the first cylinder and a second fluid to be pumped from the second cylinder and the axial movement during a second half-cycle of piston operation causing the first fluid to be pumped from the first cylinder and the second fluid to be drawn into the second cylinder; and at least one spray nozzle connected to receive the first fluid pumped from the first cylinder and second fluid pumped from the second cylinder.

27. The device of claim 26, wherein the at least one spray nozzle comprises:

at least one first spray nozzle connected to receive the first fluid pumped from the first cylinder; and at least one a second spray nozzle connected to receive the second fluid pumped from the second cylinder.

28. The device of claim 27 wherein each of the at least one first spray nozzle and the at least one second spray nozzle comprise a set of spray nozzles.

29. The device of claim 28 wherein the set of spray nozzles includes a plurality of individual nozzles.

30. The device of claim 26 wherein the at least one spray nozzle is connected to receive the first fluid pumped from the first cylinder during the first half-cycle and connected to receive the second fluid pumped from the second cylinder during the second half-cycle.

31. The device of claim 30 wherein the first fluid comprises an application liquid and the second fluid comprises a cleaning fluid.

32. The device of claim 30 wherein the at least one spray nozzle comprises a set of spray nozzles.

33. The device of claim 32 wherein the set of spray nozzles includes a plurality of individual nozzles.

34. The device of claim 26 wherein the first and second pistons have different volumes.

35. The device of claim 26 further including a source of diluent, with the sourced diluent added to one of the first or second fluids after being pumped.

36. The device of claim 26 wherein the simultaneous axial movement of the first and second pistons is in the same direction during each half-cycle.

37. The device of claim 26 wherein the drive system comprises:

a base plate to which each of the first and second cylinders are mounted;

a metering plate to which each of the first and second pistons are attached through corresponding piston rods;

a drive mechanism for reciprocally moving the metering plate relative to the base plate.

38. The device of claim 37 wherein the drive mechanism comprises a screw-type drive interconnecting the base plate and metering plate.

39. A dispensing device for uniformly delivering fluids, comprising:

a cylinder having a piston slidably received therein, the piston defining a first and second chamber within the cylinder;

a drive system adapted to cause axial movement of said piston within said cylinder, such axial movement during a first half-cycle of piston operation causing a first fluid to be drawn into the first chamber of the cylinder and a second fluid to be pumped from the second chamber of the cylinder and the axial movement during a second half-cycle of piston operation causing the first fluid to be pumped from the first chamber of the cylinder and the second fluid to be drawn into the second chamber of the cylinder; and at least one spray nozzle connected to receive the first fluid pumped from the first chamber of the cylinder and second fluid pumped from the second chamber of the cylinder.

40. The device of claim 39, wherein the at least one spray nozzle comprises:

at least one first spray nozzle connected to receive the first fluid pumped from the first cylinder; and at least one second spray nozzle connected to receive the second fluid pumped from the second cylinder.

41. The device of claim 40 wherein each of the at least one first spray nozzle and the at least one second spray nozzle comprise a set of spray nozzles.

42. The device of claim 41 wherein the set of spray nozzles includes a plurality of individual nozzles.

43. The device of claim 40 wherein the first fluid comprises an application liquid and the second fluid comprises a cleaning fluid.

44. The device of claim 39 further including a source of diluent, with the sourced diluent added to one of the first or second fluids after being pumped.

45. The device of claim 39 wherein the drive system comprises:

a base plate to which the cylinder is mounted;

a metering plate to which the piston is attached through a corresponding piston rod;

a drive mechanism for reciprocally moving the metering plate relative to the base plate.

46. The device of claim 45 wherein the drive mechanism comprises a screw-type drive interconnecting the base plate and metering plate.

47. The device of claim 39 wherein the at least one spray nozzle is connected to receive the first fluid pumped from the first chamber of the cylinder during the first half-cycle and connected to receive the second fluid pumped from the second chamber of the cylinder during the second half-cycle.

48. The device of claim 47 wherein the first fluid comprises an application liquid and the second fluid comprises a cleaning fluid.

49. The device of claim 47 wherein the at least one spray nozzle comprises a set of spray nozzles.

50. The device of claim 49 wherein the set of spray nozzles includes a plurality of individual nozzles.

51. A dispensing device for coating human skin with one or more fluid products, comprising:

at least one spray nozzle;

a first pumping mechanism that pumps fluid product through the at least one spray nozzle for application to coat human skin; and a second pumping mechanism that pumps fluid product through the at least one spray nozzle for application to coat human skin; and wherein the at least one spray nozzle includes a plurality of individual spray nozzles.

52. The device of claim 51 further including an additional pumping mechanism that pumps a supplemental fluid through the at least one spray nozzle.

53. The device of claim 52 wherein the supplemental fluid is pumped to the at least one spray nozzle simultaneously with the fluid product.

54. The device of claim 52 wherein the supplemental fluid is pumped to the at least one spray nozzle subsequent to the fluid product.

55. The device of claim 52 wherein the supplemental fluid cleans the at least one spray nozzle.

56. The device of claim 52 wherein the fluid product is a sunless tanning solution and the supplemental fluid is an accelerator for the sunless tanning solution.

57. The device of claim 52 wherein the fluid product is a sunless tanning solution and the supplemental fluid is a lotion.

58. The device of claim 51 wherein the fluid product pumped by the first pumping mechanism and the fluid product pumped by the second pumping mechanism are the same fluid product.

59. The device of claim 51 wherein the fluid product pumped by the first pumping mechanism is pumped to the at least one spray nozzle before the fluid product pumped by the second pumping mechanism is pumped to the at least one spray nozzle.

60. The device of claim 51 wherein the fluid products include a sunless tanning solution.

61. The device of claim 51 further including an enclosure within which the at least one spray nozzle is mounted, the enclosure being sized and shaped to receive at least a portion of a human body, the at least one spray nozzle positioned to coat the skin of the received portion of the human body.

62. The device of claim 61 wherein the enclosure is sized and shaped to receive an entire human body, the at least one spray nozzle positioned to coat the skin of the entire human body.

63. The device of claim 62 wherein the enclosure is a sunless tanning booth and the at least one spray nozzle applies a sunless tanning solution.

64. A dispensing device for coating human skin with one or more fluid products, comprising:

at least one spray nozzle;

a first pumping mechanism that pumps fluid product through the at least one spray nozzle for application to coat human skin; and a second pumping mechanism that pumps fluid product through the at least one spray nozzle for application to coat human skin; and wherein at least one of the first and second pumping mechanisms further pumps cleaning fluid through the at least one spray nozzle following fluid product application to the human skin.

65. A dispensing device for coating human skin with one or more fluid products, comprising:

at least one spray nozzle;

a first pumping mechanism that pumps fluid product through the at least one spray nozzle for application to coat human skin;

a second pumping mechanism that pumps fluid product through the at least one spray nozzle for application to coat human skin; and an additional pumping mechanism that pumps a supplemental fluid through the at least one spray nozzle; and wherein the additional pumping mechanism comprises one of the first and second pumping mechanisms and wherein that one of the first and second pumping mechanisms pumps fluid product in a first half-cycle of pumping operation and pumps the supplemental fluid in a second half-cycle of pumping operation.

66. A dispensing device for coating human skin with one or more fluid products, comprising:

at least one spray nozzle;

a first pumping mechanism that pumps fluid product through the at least one spray nozzle for application to coat human skin;

a second pumping mechanism that pumps fluid product through the at least one spray nozzle for application to coat human skin;

a wash nozzle; and a third pumping mechanism that draws a cleaning fluid and pumps the drawn cleaning liquid through the wash nozzle.

67. The device of claim 66 wherein the third pumping mechanism for the cleaning fluid comprises at least one of the first and second pumping mechanisms and wherein that at least one of the first and second pumping mechanisms pumps fluid product in a first half-cycle of pumping operation and pumps the cleaning fluid in a second half-cycle of pumping operation.

68. A dispensing device for more uniformly delivering fluids, comprising:

at least one spray nozzle;

a first pumping mechanism adapted to pump a first liquid product through the at least one spray nozzle;

a second pumping mechanism adapted to pump a second liquid product through the at least one spray nozzle; and a drive connected to the first and second pumping mechanisms, the drive having a cyclical operation such that the first pumping mechanism pumps the first liquid product through the at least one spray nozzle in a first half-cycle of the cyclical operation and the second pumping mechanism pumps the second fluid product through the at least one nozzle during a second half-cycle of the cyclical operation.

69. The dispensing device of claim 68, wherein the first pumping mechanism is further adapted to draw the first fluid from a first reservoir during the second half-cycle of the cyclical operation and the second pumping mechanism is adapted to draw the second fluid from a second reservoir during the first half-cycle of the cyclical operation.

70. The dispending device of claim 68, further including a source of diluent, the source of diluent added to one of the first liquid product or the second liquid product.

71. The dispensing device of claim 68, wherein the first fluid comprises a an application liquid.

72. The dispensing device of claim 68, wherein the second fluid comprises a rinsing liquid.

73. A dispensing device for uniformly delivering fluids, comprising:

a first cylinder having a first piston slidably received therein, the first piston defining a first and second chamber within the cylinder;

a second cylinder having a second piston slidably received therein;

at least one spray nozzle connected to the first chamber of the first cylinder, the second cylinder, and the second chamber of the first cylinder;

a drive system adapted to cause axial movement of said first piston within said first cylinder and axial movement of the second piston within the second cylinder, such axial movement of the first piston during a first half-cycle of operation causing a first fluid to be pumped from the first chamber of the first cylinder to the at least one spray nozzle, such axial movement of the second piston during the first half-cycle of operation causing the first fluid to be pumped from the second cylinder to the spray nozzle, and such axial movement of the first piston within the first cylinder during a second half-cycle of operation causing a second fluid to be pumped from the second chamber of the first cylinder to the at least one spray nozzle.

74. The dispensing device of claim 73, wherein the axial movement of the first piston within said first cylinder during the first half-cycle of operation causes the second fluid to be drawn into the second chamber of the first piston.

75. The dispensing device of claim 73, wherein the axial movement of the first piston within said first cylinder during the second half-cycle of operation causes the first fluid to be drawn into the first chamber of the first piston.

76. The dispending device of claim 73, further including a source of diluent, the source of diluent added to one of the first liquid product or the second liquid product.

77. The dispensing device of claim 73, wherein the first fluid comprises a an application liquid.

78. The dispensing device of claim 73, wherein the second fluid comprises a rinsing liquid.

79. A dispensing device for uniformly delivering fluid, comprising:

a first cylinder having a first piston slidably received therein;

a second cylinder having a second piston slidably received therein;

a drive system adapted to cause simultaneous axial movement of said first and second pistons within said first and second cylinders, respectively, such axial movement during a first half-cycle of piston operation causing a first fluid to be pumped from the first cylinder and a second fluid to be pumped from the second cylinder, and the axial movement during a second half-cycle of piston operation causing the first fluid to be drawn into the first cylinder and the second fluid to be drawn into the second cylinder; and at least one spray nozzle connected to simultaneously receive the first fluid pumped from the first cylinder and the second fluid pumped from the second cylinder.

80. The dispensing device of claim 79, wherein the first fluid comprises a an application liquid.

81. The dispensing device of claim 79, wherein the second fluid comprises a rinsing liquid.

82. The dispensing device of claim 79, wherein a diameter of the first cylinder is different from a diameter of the second cylinder.

* * * * *

UNITED STATES PATENT AND TRADEMARK OFFICE

CERTIFICATE OF CORRECTION

PATENT NO. : 7,004,407 B2
APPLICATION NO. : 10/310743
DATED : February 28, 2006
INVENTOR(S) : Steven C. Cooper It is certified that error appears in the above-identified patent and that said Letters Patent is hereby corrected as shown below:

| | |
|---|---|
| Column 1, line 59 | Replace "contemplated"<br>With --completed-- |
| Column 5, line 63 | Replace "T-driver 130"<br>With --T-divider 130-- |

Signed and Sealed this

Ninth Day of January, 2007

JON W. DUDAS
*Director of the United States Patent and Trademark Office*